US009828710B2

(12) United States Patent
Schwarzberger

(10) Patent No.: US 9,828,710 B2
(45) Date of Patent: Nov. 28, 2017

(54) SYSTEM AND METHOD FOR CAPTURING THREAD FROM AN ENTRAINING AIR FLOW

(71) Applicant: ABM International, Inc., The Woodlands, TX (US)

(72) Inventor: Neal A. Schwarzberger, The Woodlands, TX (US)

(73) Assignee: ABM International, Inc., The Woodlands, TX (US)

( * ) Notice: Subject to any disclaimer, the term of this patent is extended or adjusted under 35 U.S.C. 154(b) by 1038 days.

(21) Appl. No.: 14/090,791

(22) Filed: Nov. 26, 2013

(65) Prior Publication Data

US 2014/0158035 A1 Jun. 12, 2014

Related U.S. Application Data

(60) Provisional application No. 61/729,913, filed on Nov. 26, 2012.

(51) Int. Cl.
*D05B 65/06* (2006.01)

(52) U.S. Cl.
CPC ..... *D05B 65/06* (2013.01)

(58) Field of Classification Search
CPC ... D05B 65/06; A47L 9/22; A47L 5/28; A47L 5/24; D05D 2207/04
See application file for complete search history.

(56) References Cited

U.S. PATENT DOCUMENTS

| | | | | |
|---|---|---|---|---|
| 3,786,531 | A * | 1/1974 | Borg | A47L 23/263 15/161 |
| 4,947,510 | A * | 8/1990 | English | A47L 7/0047 15/301 |
| 5,655,253 | A * | 8/1997 | Nevin | A47L 7/00 15/310 |
| 6,743,281 | B1 * | 6/2004 | Miller | B01D 46/0086 116/DIG. 25 |
| 6,817,306 | B2 | 11/2004 | Nakata | |
| 7,356,872 | B2 * | 4/2008 | Jones | A47L 5/38 15/310 |
| 8,092,564 | B2 * | 1/2012 | Totsugi | A47L 9/281 15/301 |
| 2002/0046437 | A1 * | 4/2002 | Bailey | A47L 5/24 15/310 |

* cited by examiner

*Primary Examiner* — Dung Van Nguyen
(74) *Attorney, Agent, or Firm* — Brian B. Shaw, Esq.; Harter Secrest & Emery LLP

(57) ABSTRACT

A system and method for capturing thread from an entraining air flow is provided, wherein the entraining airflow is selectively created in response to a location of the user relative to the device. The entraining airflow is sufficient to entrain an anticipated length of the thread, wherein the entraining airflow then passes through a grill. The grill shape, the airflow rate and the airflow velocity are selected to retain the entrained thread on the grill. The airflow is then terminated without requiring user intervention. Upon retention of a number of threads on the grill, the grill is separated from the housing and the retained threads are simultaneously disposed of in a desired container.

12 Claims, 2 Drawing Sheets

SYSTEM AND METHOD FOR CAPTURING THREAD FROM AN ENTRAINING AIR FLOW

FIELD OF THE INVENTION

The present invention relates to a system and method for selectively creating an airflow sufficient to entrain an anticipated length of the thread and capturing the length of thread from the airflow to provide for selective removal of a captured thread length from the airflow.

BACKGROUND OF THE INVENTION

U.S. Pat. No. 6,817,306 discloses a cut looper thread disposal means at a side location of the needle and orthogonal to the sewing direction. This disposal means includes a thread suction tube (thread suction device), a thread pick and pull cylinder, and a looper thread presser foot. The thread suction tube sucks and collects the part of the looper thread cut by the stationary blade, at a single location, that is, in the vicinity of a suction port. The thread pick and pull cylinder picks at a pick part of the looper thread and pulls it into the vicinity of the suction part of the suction tube.

However, this machine mounted, automated device is not applicable to individual users. Further, this device is integral with the sewing machine and is not compatible with any retrofit of the machine. That is, the device has limited applicability for individual users.

BRIEF SUMMARY OF THE INVENTION

The present disclosure provides a thread capturing apparatus including a housing having an inlet and an outlet, the inlet at least partially defined by a throat having a converging section; a grill removably connected relative to the housing, the grill located proximal to the throat; a motor within the housing; a fan connected to the motor and disposed within the housing, the fan selected to create an airflow through the housing from the inlet to the outlet; and a proximity sensor initiating rotation of the fan in response to a portion of the user being located within (i) a substantially predetermined distance from the housing or (ii) a detecting region/volume of the proximity sensor.

In a further configuration, the housing has a removable wall selectively providing access to the fan independent of the inlet and the outlet of the housing. Further, the housing, the motor, and the fan can be sized to entrain a thread within the created air flow through the throat.

A method is provided including the steps of initiating an airflow through a converging throat into a housing in response to locating a portion of the thread within a given distance or volume from the converging throat or a grill adjacent to the converging throat, at least a portion of the airflow passing through the grill; at least partially entraining the thread in the airflow through the grill to engage the thread on the grill; and automatically terminating airflow through the converging throat.

It is further contemplated, the airflow can be initiated in response to one of a portion of the user and the thread being disposed within a given distance from the throat or within a detecting volume of the proximity sensor.

BRIEF DESCRIPTION OF THE SEVERAL VIEWS OF THE DRAWING(S)

DETAILED DESCRIPTION OF THE INVENTION

Figure 1:
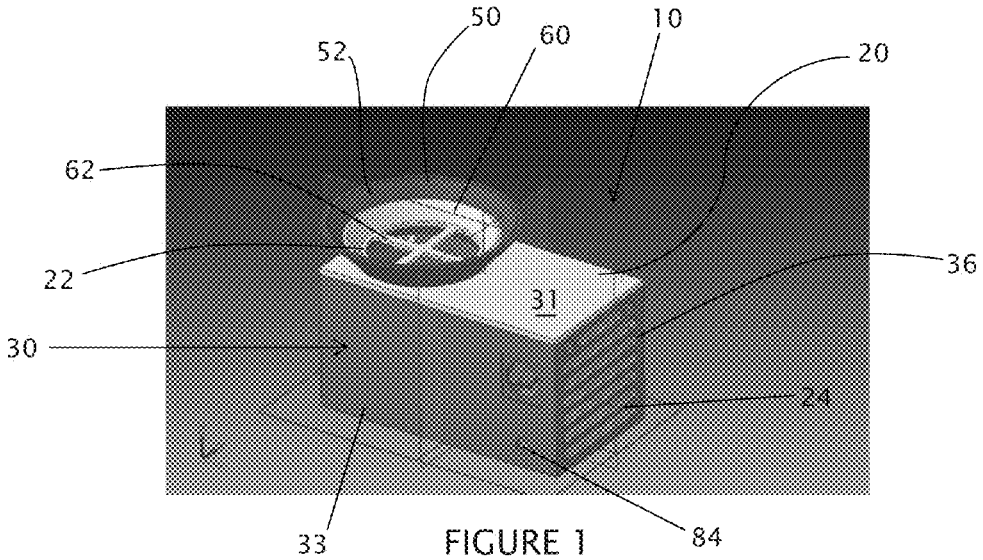
FIG. 1 is a perspective view of the thread capturing device, with a portion of the device removed for illustration purposes.

The thread capturing device 10 includes a housing 20 having an inlet 22 and an outlet 24; a fan assembly 40 and a removable grill 60.

The housing 20 generally includes an enclosing body 30 such as having top 31, bottom 32, left 33, right 34, front 35 and back 36 walls. It is contemplated the top 31, bottom 32, left 33, right 34, front 35 and back 36 walls can be individually formed or as many as five of the walls can be integrally formed such as by casting or molding.

One of the walk includes the inlet 22 and another wall includes the outlet 24. As seen in FIG. 1, the top wall 31 or lid includes the inlet 22 and the back wall 36 includes the outlet 24.

Figure 2:
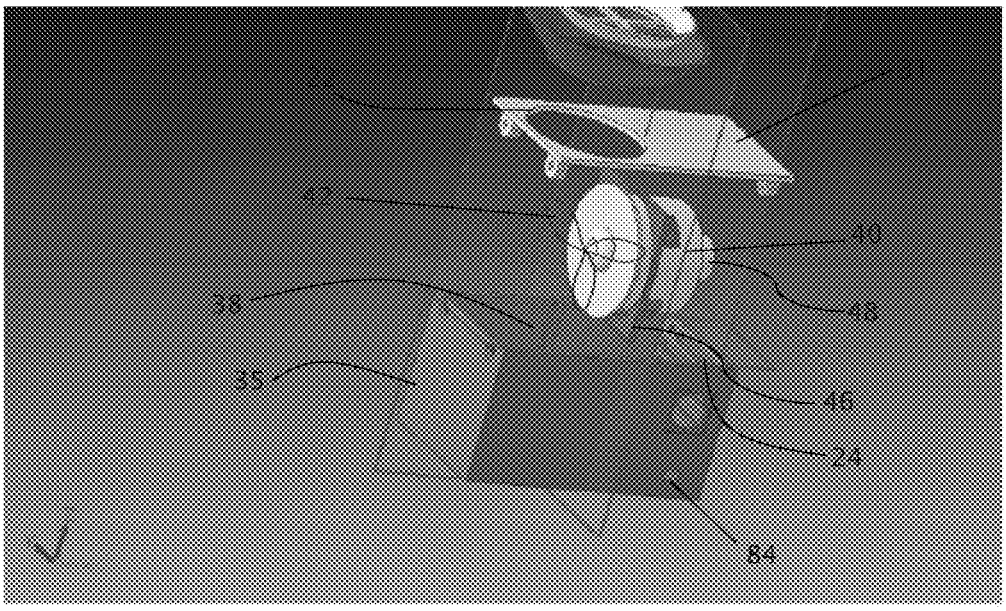
FIG. 2 is an exploded perspective view of the thread capturing device.

In one configuration of the housing 20, as seen in FIG. 2, the side walk 33, 34 include opposing retaining channels 38 on an inside surface of the walls.

The housing 20 can be formed from a variety of materials including metals, plastics, composites, or laminates. A representative size of the housing 20 is approximately 4 inches wide, approximately 8 inches long, and approximately 8 inches tall.

The inlet 22 has an area of approximately 16 square inches and the outlet 24 has at least approximately 16 square inches.

As seen in FIG. 2, the lid or top wall 31 can be removably attached to the remaining walls for accessing the interior of the housing 20 and the fan assembly 40.

As seen in FIG. 2, the fan assembly 40 includes a plurality of blades 42, a motor 44 and an engaging collar 46, wherein peripheral edges of the engaging collar are sized to be received within the retaining channels 38 of the side walls 33, 34, thereby locating the fan assembly relative to the housing 20.

The fan blades 42 are selected to provide a relatively high flow at a given rotation rate. Satisfactory fan blades 42 have been found to have a dimension of approximately 2.5 inches. The fan blades 42 can number from 2 to 5 or more.

The motor 44 can be driven by an internal power source 48, such as a battery or plurality of batteries retained within the housing 20, or an external source by means of an electrical plug. A satisfactory motor 44 includes a dc motor of approximately 33 watts. However, as discussed below, the specific speed of the motor 44 is at least partly determined by the sizing of the housing 20 inlet and the configuration of the fan blades 42.

In one configuration the fan assembly 40, the housing inlet 22 and housing outlet 24 are selected to provide an air flow of about between 3 and 8 ounces thrust.

Referring to FIGS. 1 and 2, the thread capturing device 10 includes a throat 50 proximal to the inlet 22 of the housing 20, wherein the throat defines a converging section 52 extending from a wide end to a narrow end. The throat 50 can be fixedly or removably attached to the housing 20. In one configuration the throat 50 converges by between 10% and 70%. That is, the area of narrow end can be approximately 90% to 30% of the area of the wide end.

Figure 3:
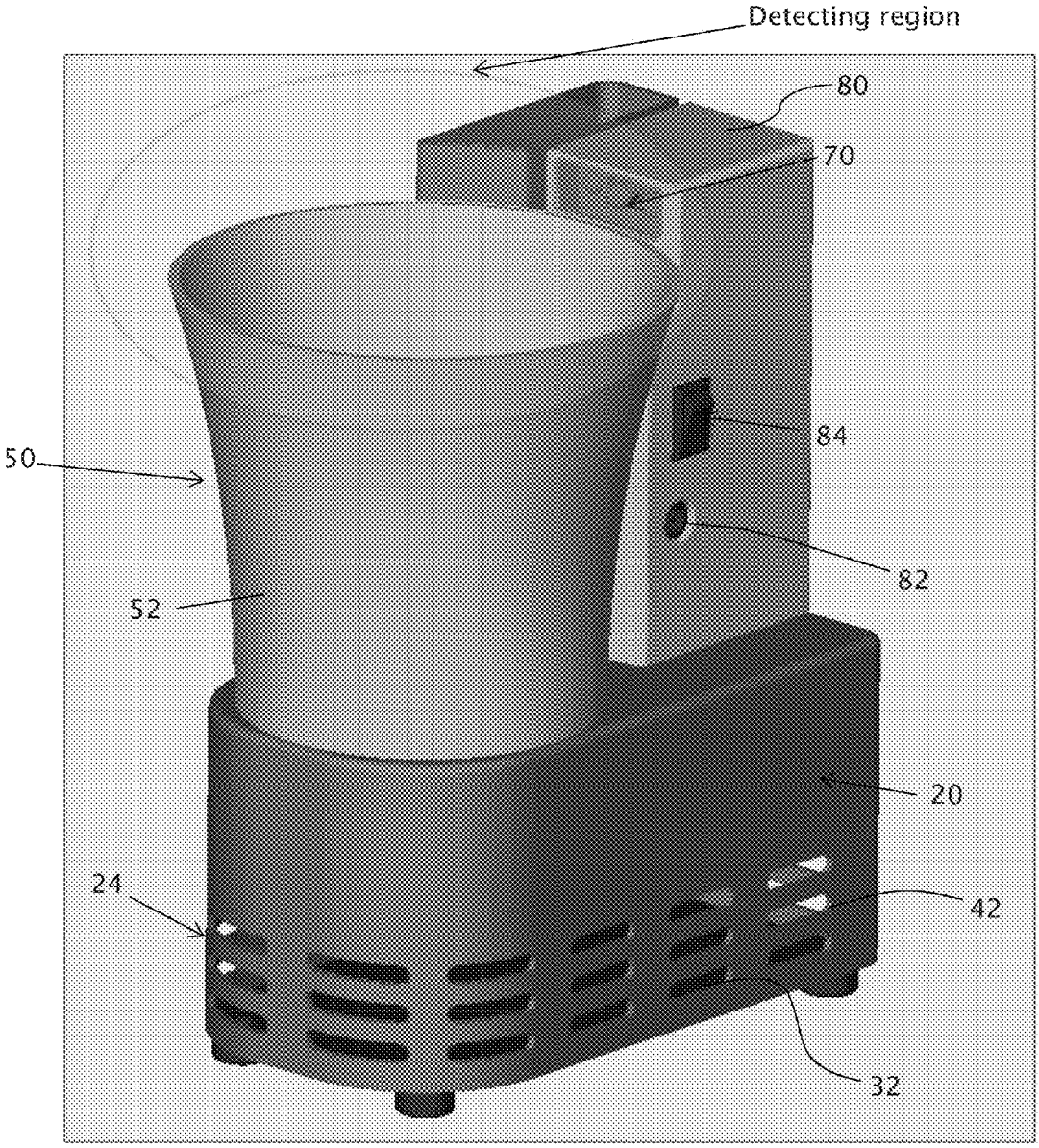
FIG. 3 is a perspective view of an alternative configuration of the device.

The removable grill 60 is disposed within the throat 50. The grill 60 is removably located relative to the housing 20, such as by removably connecting the grill to the throat 50 which is affixed to the housing or affixing the grill relative to the throat, wherein the throat is removably attached to the housing. The grill 60 or throat 50 can be removably connected by gravity or a retaining mechanism such as magnets, detents, snap-fit, threads, or hook and loop fasteners. In FIG. 3, the grill 60 is located at or proximal to the bottom of the throat 50. Thus, the throat 50 and the grill 60 can be simultaneously removed, cleaned and replaced. However, it is also contemplated the grill 60 can be operably located nearer the inlet of the throat 50 such that the grill (and enmeshed threads) can be removed from the throat, the grill cleaned and replaced.

The grill 60 includes at least one and more preferably, a plurality of slats or bars 62 extending across the area of the throat. The slats 62 are selected to engage the threads entrained in a passing airflow. Therefore, the slats 62 can have a cross section configured to enhance engagement with the threads. The slats 62 can also have a relatively abrupt edge or leading edge to assist in retention of threads. In one configuration, the grill 60 has a mesh size between approximately 15 mm to 200 mm, such that the threads accumulate on the grill.

The grill 60 is operably retained within or connected to the throat 50 such that a portion of the grill and slats 62 occlude a portion of the inlet 22.

The thread capturing device 10 can include a proximity sensor 70 known in the art, wherein the proximity sensor is configured to detect the presence of a user within a predetermined location of the housing 20, such as the inlet 22. The proximity sensor 70 can define a detecting region or volume, wherein the presence of a portion of the user within the zone is sensed and causes activation of the fan assembly 40. In one configuration, the proximity sensor 70 is selected to detect a user's hand within approximately 6 inches of the inlet. That is, the detecting region has a six inch dimension. Depending on the proximity sensor 70, the zone sensed by the proximity sensor can be substantially spherical or having generally planar edges. The proximity sensor 70 is operably connected to the fan assembly 40 or the power supply 48 for initiating rotation of the blades 42.

It is also contemplated the thread capturing device 10 can include a control switch 74 for selectively disposing the device in an operative state or an inoperative state. The control switch 74 can be connected to at least one of the power source 48, the motor 44 and the proximity sensor 70.

A controller 80 or timer (which can be integral with the controller or separate component 82, is operably connected to at least one of the fan assembly 40, the proximity sensor 70 and the power source 48. The controller 80 or timer 82 is configured to maintain operation of the fan assembly 40 for a fixed period of time from activation, or from the last activation. Satisfactory periods of operation include between approximately 1 to 8 seconds. Thus, the fan assembly 40 terminates operation independent of user intervention.

In operation, a user having a thread to be captured passes their hand within the detecting region of the proximity sensor 70. Upon the proximity sensor 70 detecting passage or presence of the hand, the proximity sensor initiates rotation of the fan assembly 40 which creates an airflow across the grill 60 through the inlet 22 of the housing 20 and to the outlet 24 of the housing.

The airflow is sufficient to entrain an anticipated length of thread such as between approximately one quarter inch to 6 or 12 inches from within the detecting zone of the proximity sensor 70. The thread is typical sewing thread for residential or even commercial weight, such as fixed length of one inch to 6 inches.

As the generated airflow passes by the hand of the user (the hand having the thread), the length of thread is entrained within the airflow and removed from the hand. The airflow than passes across the grill 60 and the thread engages portions of the slats 62 and is thus retained by the grill. The controller 80 or timer 82 then terminates operation of the fan assembly 40 after the predetermined time period has elapsed since the last actuation of the proximity sensor 70 or fan assembly.

Upon collection of a given number of threads on the grill 60, the user can use a control button 84 to place the thread capturing device in an inoperative state. The control button 84 can be in the form of a shut off, disable or disconnect switch between the power source 48 and the fan assembly 40. The user can then remove the grill 60 (or the grill and the throat 50) along with the captured threads. The captured threads from the removable grill 60 can then be readily disposed as a group into an appropriate disposal mechanism.

The removable grill 60 (or grill and throat 50) is then reengaged with the housing 20 and the control button 84 is actuated to render the capturing device in the operative state and the cycle can repeat.

Although the present invention has been described in terms of preferred embodiments, it will be understood that variations and modifications may be made without departing from the true spirit and scope thereof.

The invention claimed is:

1. A thread capturing apparatus, comprising:

(a) a housing having an inlet and an outlet, the inlet at least partially defined by a throat having a converging section;

(b) a grill removably connected relative to the housing, the grill located proximal to the throat;

(c) a DC motor within the housing;

(d) a fan connected to the motor and disposed within the housing, the fan selected to create an airflow through the housing from the inlet to the outlet; and (e) a proximity sensor initiating rotation of the fan in response to a portion of the user being located within a substantially predetermined distance from the housing.

2. The thread capturing apparatus of claim 1, wherein the housing has a removable wall selectively providing access to the fan independent of the inlet and the outlet of the housing.

3. The thread capturing apparatus of claim 1, wherein the housing, the motor, and the fan are sized to provide sufficient airflow through the throat to entrain a thread released within the predetermined distance in the airflow.

4. The thread capturing apparatus of claim 1, wherein a cross-sectional area of the outlet is greater than a cross-sectional area of the throat.

5. The thread capturing apparatus of claim 1, further comprising a power supply within the housing.

6. The thread capturing apparatus of claim 1, the fan creating a sufficient airflow through the inlet to engage a length of thread between approximately 0.5" to 8" with the grill.

7. The thread capturing apparatus of claim 1, wherein the throat is removably connected to the housing.

8. The thread capturing apparatus of claim 7, wherein the throat and the grill are removably connected to the housing.

9. The thread capturing apparatus of claim 1, wherein the proximity sensor initiates termination of the airflow in response to the portion of the user being outside the substantially predetermined distance from the housing.

10. The thread capturing apparatus of claim 1, further comprising a timer connected to at least one of the fan and the proximity sensor for initiating termination of the airflow.

11. The thread capturing apparatus of claim 1, wherein the grill includes a plurality of bars configured to capture a length of thread entrained in the airflow.

12. The thread capturing apparatus of claim 1, further comprising a controller operably connected to at least one of the fan and the proximity sensor, the controller initiating termination of the airflow.

* * * * *